US008464568B2

(12) United States Patent
Nakaike et al.

(10) Patent No.: US 8,464,568 B2
(45) Date of Patent: Jun. 18, 2013

(54) PRODUCTION METHOD OF SEAMLESS PIPE OR TUBE, AND OXIDIZING GAS SUPPLY UNIT

(75) Inventors: Kouji Nakaike, Wakayama (JP); Yasuyoshi Hidaka, Kobe (JP); Hiroshi Nogami, Takatsuki (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 627 days.

(21) Appl. No.: 12/225,726

(22) PCT Filed: Mar. 20, 2007

(86) PCT No.: PCT/JP2007/055615

§ 371 (c)(1), (2), (4) Date: Oct. 29, 2010

(87) PCT Pub. No.: WO2007/114041

PCT Pub. Date: Oct. 11, 2007

(65) Prior Publication Data

US 2011/0239720 A1 Oct. 6, 2011

(30) Foreign Application Priority Data

Mar. 31, 2006 (JP) ..... 2006-096888

(51) Int. Cl.
*B21B 19/04* (2006.01)
*B21B 17/10* (2006.01)

(52) U.S. Cl.
USPC ..... 72/97; 72/208

(58) Field of Classification Search
USPC ..... 72/96, 97, 208, 209, 38, 95, 69
See application file for complete search history.

(56) References Cited

U.S. PATENT DOCUMENTS

| | | | | |
|---|---|---|---|---|
| 5,501,091 | A * | 3/1996 | Hayashi | 72/208 |
| 5,584,203 | A * | 12/1996 | Eversberg et al. | 72/209 |
| 5,699,690 | A * | 12/1997 | Furugen et al. | 72/97 |
| 7,293,443 | B2 * | 11/2007 | Hayashi | 72/97 |
| 8,047,039 | B2 * | 11/2011 | Hidaka et al. | 72/208 |

FOREIGN PATENT DOCUMENTS

| | | |
|---|---|---|
| JP | 4-111907 | 4/1992 |
| JP | 6-182427 | 7/1994 |
| JP | 8-57505 | 3/1996 |
| JP | 8-90013 | 4/1996 |
| JP | 8-224611 | 9/1996 |
| JP | 11-90511 | 4/1999 |
| JP | 2000-24706 | 1/2000 |
| JP | 2001-105007 | 4/2001 |

OTHER PUBLICATIONS

Machine Translation of Abe et al. JP8057505.*

* cited by examiner

*Primary Examiner* — Dana Ross
*Assistant Examiner* — Mohammad I Yusuf
(74) *Attorney, Agent, or Firm* — Clark & Brody

(57) ABSTRACT

A production method of a seamless pipe or tube according to the present invention comprises the steps of applying a lubricant containing carbon to a mandrel bar, producing a material pipe or tube with a mandrel mill using the mandrel bar to which the lubricant is applied, and reheating the material pipe or tube in a reheating furnace, wherein when a temperature of the material pipe or tube is 550° C. or higher and 1000° C. or lower in the reheating step, an oxidizing gas is fed into the material pipe or tube.

2 Claims, 5 Drawing Sheets

PRODUCTION METHOD OF SEAMLESS PIPE OR TUBE, AND OXIDIZING GAS SUPPLY UNIT

TECHNICAL FIELD

The present invention relates to a method of producing a seamless pipe or tube by reheating a material pipe or tube produced with a mandrel mill in a reheating furnace and an oxidizing gas supply unit used therein, and particularly to a production method of a seamless pipe or tube and an oxidizing gas supply unit by which carburizing likely produced on an inner surface of a pipe or tube can be inhibited simply and effectively. Hereinafter, "pipe or tube" is referred to as "pipe" when deemed appropriate.

BACKGROUND ART

As a production method of a seamless pipe, various method such as a mandrel mill method, a plug mill method, a Eugene Sejerne method, and a Erhardt Push Bench method are known. The production method of the mandrel mill method, which is superior in all aspects such as productivity, dimensional precision and inner and outer surface quality, of these methods is widely employed.

In the production method of a seamless pipe based on the mandrel mill method, as shown in FIG. 1, a billet 1 is heated to a predetermined temperature (generally 1100 to 1300° C.) in a heating furnace 2 and then subjected to piercing and rolling by a piercer 3 to produce a hollow shell 4. This pierced hollow shell 4 is subjected to drawing and rolling in a mandrel mill 5 to produce a material pipe 4'.

In the mandrel mill 5, the pierced hollow shell 4 is subjected to drawing and rolling with a mandrel bar 6 with a lubricant containing carbon such as graphite or the like applied to its surface inserted into the hollow shell 4. Then, the material pipe 4' is re-heated to a predetermined temperature (generally 850 to 1150° C.) in a reheating furnace 7 and subjected to finish rolling by a swaging rolling mill 8 such as a stretch reducer or a sizer.

Here, when a material of the material pipe 4' is low carbon steel such as austenitic stainless steel (SUS 304, SUS 316, etc.) or the like, if the material pipe 4' is subjected to drawing and rolling with the mandrel bar 6 with a lubricant containing carbon applied to its surface inserted into the material pipe 4' and re-heated, a carburizing phenomenon, in which a carburized layer having a higher carbon content is formed at an inner surface of the material pipe 4', occurs.

When this carburized layer remains in pipe products, for example, carbon steel pipe products, the carburized layer becomes an anomalous hardened portion, and cutting becomes difficult for this portion. When the pipe product is austenitic stainless steel, corrosion resistance such as intergranular corrosion resistance is deteriorated.

Accordingly, hitherto, various methods for inhibiting the carburizing of the inner surface of the seamless pipe or for promoting the decarburization of the inner surface of the seamless pipe have been proposed.

For example, it is proposed to limit an amount of the graphite adhering to the surface of the mandrel bar to 100 $mg/m^2$ or less when a hollow shell is subjected to drawing and rolling by the mandrel mill (for example, refer to Japanese Unexamined Patent Publication No. 2000-24706).

However, it is unfeasible in a production line where the graphite lubricant is used once to limit an amount of the graphite adhering to as a trace amount as 100 $mg/m^2$ or less as proposed in the above Japanese Unexamined Patent Publication No. 2000-24706. The reason for this is that when the graphite lubricant is used once, it adheres to a mandrel bar carrying facilities or the like and is suspended in the atmosphere of a plant. It takes immeasurable costs in order to realize the proposed method, so this method is not effective.

Further, a method, in which the lubricant or the carburized layer remaining on the inner surface of the material pipe rolled in the mandrel mill is removed by use of an abrasive or high-pressure water, is proposed (for example, Japanese Unexamined Patent Publication No. 4-111907, Japanese Unexamined Patent Publication No. 6-182427, Japanese Unexamined Patent Publication No. 8-224611, and Japanese Unexamined Patent Publication No. 2001-105007).

However, the method of removing the carburized layer or the like by use of an abrasive is unfeasible since the cost of abrasive such as hone is expensive and it takes the time to grind the material pipe. Further, by the method of removing the lubricant or the like by use of high-pressure water, the material pipe is nonuniformly cooled. And, this material pipe may be bent by reheating and may inhibit an operation.

Furthermore, a method, in which the carburizing is inhibited or the decarburization is promoted by feeding an oxidizing gas into the material pipe in the reheating furnace, is also proposed (for example, refer to Japanese Unexamined Patent Publication No. 8-57505 and Japanese Unexamined Patent Publication No. 8-90043).

However, a temperature of the material pipe at the time when the oxidizing gas is fed or a required flow rate of the oxidizing gas is not disclosed in any Patent Publication described above. In these Patent Documents, it is just disclosed that the oxidizing gas is indefinitely fed into the material pipe in the reheating furnace, and thereby carbon is oxidized to inhibit carburizing or to promote decarburization. As described later, according to the intensive investigations made by the present inventors, it became apparent that the oxidizing gas may have to be fed excessively in order to prevent the carburized layer from being produced depending on a temperature of the material pipe at the time when the oxidizing gas is fed. When an amount of the oxidizing gas to be fed is increased, the unit requirement of the oxidizing gas is increased, which results in an increase in the production cost of the seamless pipe. Further, when a feed rate of the oxidizing gas is increased, since the temperature of atmosphere in the reheating furnace tends to be lowered, large scale combustion facilities become necessary. That is, there is a problem that this method causes an increase in the production cost or the facilities cost.

DISCLOSURE OF THE INVENTION

The present invention was made to solve the problems of the related art, it is an object of the present invention to provide a production method of a seamless pipe and an oxidizing gas supply unit by which carburizing likely produced on an inner surface of a material pipe can be inhibited simply and effectively.

The present inventors made intensive investigations in order to solve the above-mentioned problems, and consequently found the following matters (A) to (C).

(A) In a state in which a temperature of the material pipe introduced in the reheating furnace is lower than 550° C., the carbon adhering to the inner surface of the material pipe does not burn even when the oxidizing gas is fed into the material pipe. Therefore, it becomes necessary to oxidize (decarburize) the carbon diffused from the inner surface of the material pipe to the inside of the material pipe in order to prevent the carburized layer from being produced (from remaining) in the seamless pipe. That is, since it becomes necessary to oxidize the carbon permeated into solid (material pipe), a large amount of the oxidizing gas needs to be fed as shown by an arrow A in FIG. 2.

(B) On the other hand, in a state in which a temperature of the material pipe introduced in the reheating furnace is higher than 1000° C., it is estimated that the carbon adhering to the inner surface of the material pipe burns when the oxidizing gas is fed into the material pipe, but a rate at which the carbon is diffused from the inner surface of the material pipe to the inside of the material pipe is larger than this burning rate. Therefore, in order to prevent the carburized layer from being produced (from remaining) in the seamless pipe, it becomes necessary to oxidize (decarburize) the carbon diffused from the inner surface of the material pipe to the inside of the material pipe as with the case where a temperature of the material pipe is lower than 550° C. That is, since it becomes necessary to oxidize the carbon permeated into solid (material pipe), a large amount of the oxidizing gas needs to be fed as shown by an arrow B in FIG. 2.

(C) Accordingly, in a state in which a temperature of the material pipe introduced in the reheating furnace is 550° C. or higher and 1000° C. or lower, if the oxidizing gas is fed into the material pipe, as shown by an arrow C in FIG. 2, the carbon adhering to the inner surface of the material pipe can be burnt even though an amount of the oxidizing gas fed into the material pipe is small, while the diffusion of the carbon from the inner surface of the material pipe to the inside of the material pipe can be inhibited.

The present invention has been accomplished with the above-described findings of the inventors. That is, the present invention provides a production method of a seamless pipe or tube comprising the steps of applying a lubricant containing carbon to a mandrel bar, producing a material pipe or tube with a mandrel mill using the mandrel bar to which the lubricant is applied, and reheating the material pipe or tube in a reheating furnace, wherein when a temperature of the material pipe or tube is 550° C. or higher and 1000° C. or lower in the reheating step, an oxidizing gas is fed into the material pipe or tube.

In accordance with the present invention, the carbon adhering to the inner surface of the material pipe or tube can be burnt even though an amount of the oxidizing gas fed into the material pipe or tube is small, while the diffusion of the carbon from the inner surface of the material pipe or tube to the inside of the material pipe or tube can be inhibited, and therefore carburizing likely produced on an inner surface of the material pipe or tube can be inhibited effectively. Further, since a required amount of the oxidizing gas fed is small, a production cost and a facilities cost of the seamless pipe or tube can be inhibited and carburizing can be readily inhibited.

In the above-described production method of a seamless pipe or tube according to the present invention, a flow rate of the oxidizing gas fed into the material pipe or tube is preferably determined so as to satisfy the condition of the following equation (1):

$$Q \geq 7.7394 \times 10^{12} \cdot \exp\left(-\frac{22748}{(T_\infty + T_p) \times 0.5 + 273}\right) \cdot \frac{C_{in}}{T_{in} + 273} \cdot \frac{1}{\rho_c D_c} \cdot A_b \cdot \pi D_p L_p \quad (1)$$

wherein

Q represents a flow rate of the oxidizing gas [Nl/sec], $T_\infty$ represents a temperature of atmosphere in the reheating furnace [° C.], $T_p$ represents a temperature of the material pipe or tube at the time when the material pipe or tube is introduced into the reheating furnace [° C.], $C_{in}$ represents an oxygen content of the oxidizing gas [vol. %], $T_{in}$ represents a temperature of the oxidizing gas [° C.], $\rho_c$ represents a particle density of carbon which the lubricant applied to the mandrel bar contains [kg/m$^3$], $D_c$ represents a particle diameter of carbon which the lubricant applied to the mandrel bar contains [μm], $A_b$ represents an adhesion density of carbon which the lubricant applied to the mandrel bar contains [g/m$^2$], π represents Ludolphian number, Dp represents an inner diameter of the material pipe or tube [m] and $L_p$ represents a length of the material pipe or tube [m].

In accordance with such the preferable constitution, a measure of a flow rate Q of the oxidizing gas to be fed can be obtained, and thus the flow rate to be fed can be reduced to the flow rate equal to the right side of the equation (1).

Also, the present invention provides an oxidizing gas supply unit used in the reheating step in the above-mentioned production method of a seamless pipe or tube. Specifically, the oxidizing gas supply unit is installed in a walking beam reheating furnace in which the material pipe or tube is placed on one of pockets provided on a moving beam and a fixed beam and successively shifted to the other pocket alternately between two kinds of beams to be carried. And, the oxidizing gas supply unit includes nozzles which are respectively disposed at the sides of a plurality of successive pockets provided from the side, which is closest to the material pipe or tube introducing inlet of the fixed beam, toward the material pipe ore tube carrying out side of the fixed beam and each of which ejects an oxidizing gas toward the inside of the material pipe placed on each pocket of the fixed beam.

The oxidizing gas supply unit of the present invention has a constitution of including nozzles to eject the oxidizing gas at the sides of a plurality of successive pockets provided from the side, which is closest to the material pipe or tube introducing inlet of the fixed beam of a walking beam reheating furnace toward the material pipe or tube carrying out side of the fixed beam. In accordance with such the constitution, the oxidizing gas can be fed into the material pipe or tube almost continuously during a process from immediately after the material pipe or tube is introduced into the reheating furnace to the material pipe or tube is carried through the reheating furnace. Therefore, even when a temperature of atmosphere in the reheating furnace is higher than 1000° C., the oxidizing gas can be fed before a temperature of the material pipe or tube is elevated and becomes equal to the temperature of atmosphere in the reheating furnace (that is, a temperature of the material pipe or tube is higher than 1000° C.) and it is possible to satisfy the condition that the oxidizing gas is fed when a temperature of the material pipe is 1000° C. or lower.

Further, when a temperature of the material pipe or tube at the time when the material pipe or tube is introduced into the reheating furnace is lower than 550° C., the ejection of the oxidizing gas from a nozzle, which is provided at a position where a temperature of the material pipe or tube is still lower than 550° C., of a plurality of nozzles successively installed can be stopped, and the oxidizing gas can be ejected from a nozzle at first, which is provided at a position where a temperature of the material pipe or tube can be elevated to 550° C. or higher when the material pipe or tube is carried through the reheating furnace, of a plurality of nozzles successively installed. Alternatively, the ejection of the oxidizing gas from a nozzle, which is provided at a position where a temperature of the material pipe or tube is still lower than 550° C., doesn't have to be stopped as long as the oxidizing gas is ejected from a nozzle, which is provided at a position where a temperature of the material pipe or tube can be elevated to 550° C. or higher when the material pipe or tube is carried through the reheating furnace. Therefore, even when a temperature of the material pipe or tube just before being introduced into the reheating furnace is lower than 550° C., it is possible to satisfy the condition of feeding the oxidizing gas when a temperature of the material pipe or tube is 550° C. or higher.

Thus, in accordance with the oxidizing gas supply unit of the present invention, when a temperature of the material pipe or tube introduced in the reheating furnace is 550° C. or higher and 1000° C. or lower, the oxidizing gas can be fed into the material pipe or tube.

BEST MODE FOR CARRYING OUT THE INVENTION

Hereinafter, an embodiment of the present invention will be described with appropriate reference to the accompanying drawings.

Figure 3A:
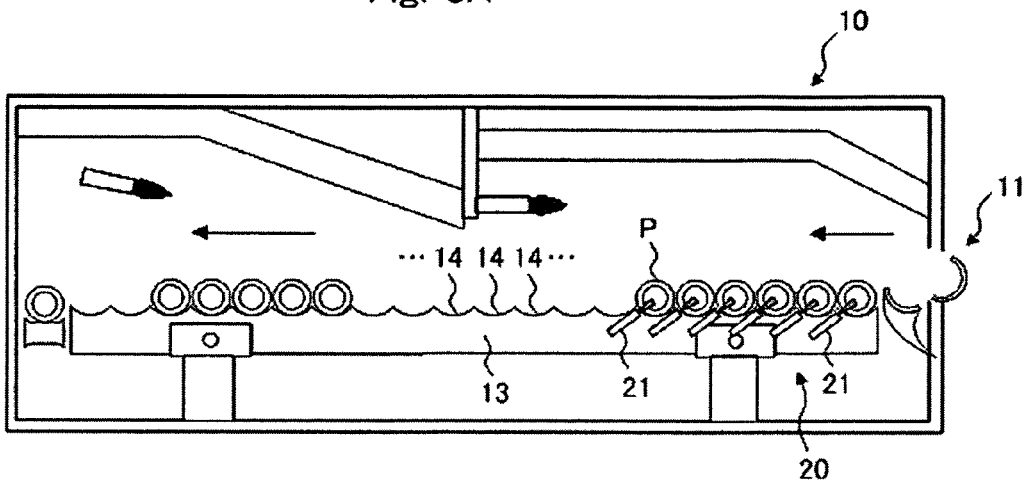
FIG. 3 (FIGS. 3A and 3B) are schematic views showing schematic constitutions of a reheating furnace and an oxidizing gas supply unit installed at the reheating furnace, to which a production method of a seamless pipe of an embodiment of the present invention is applied.
Figure 3B:
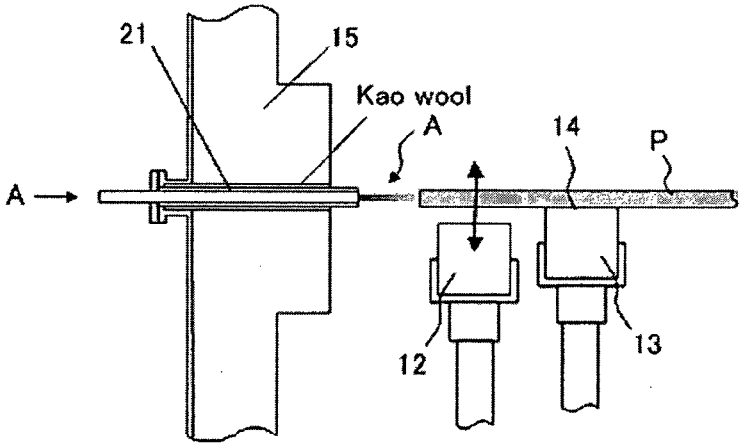

FIG. 3 are schematic views showing schematic constitutions of a reheating furnace and an oxidizing gas supply unit installed at the reheating furnace, to which a production method of a seamless pipe of an embodiment of the present invention is applied. FIG. 3A is a front sectional view and FIG. 3B is a side sectional view. As shown in FIG. 3, a reheating furnace 10 of the present embodiment is a so-called walking beam reheating furnace. The material pipe P subjected to drawing and rolling in a mandrel mill is introduced into the reheating furnace 10 through an inlet 11, and placed on one of pockets 14 provided on a moving beam 12 and a fixed beam 13 and successively shifted to the other pocket alternately between two kinds of beams to be carried in a direction of an arrow of FIG. 3A.

The oxidizing gas supply unit (hereinafter, appropriately referred to as a "gas supply unit") 20 is installed in the reheating furnace 10. The gas supply unit 20 includes nozzles 21 which are respectively disposed at the sides of a plurality (6 in the present embodiment) of successive pockets 14 provided from the side of the fixed beam 13 closest to the inlet 11 toward the material pipe carrying out side of the fixed beam 13, and each of which ejects an oxidizing gas (air in the present embodiment) A toward the inside of the material pipe P placed on the foregoing each pocket 14 of the fixed beam 13. More specifically, each nozzle 21 is inserted into a side wall 15 of the reheating furnace 10 positioned at the sides of the above-mentioned successive pockets 14 of the fixed beam 13. And, each nozzle 21 is constructed so as to eject the air A having flown in from a base portion through a nozzle tip toward the inside of the material pipe P.

In the production method of a seamless pipe of the present embodiment, the air A is fed into the material pipe P by use of the gas supply unit 20 when a temperature of the material pipe P introduced in the reheating furnace 10 is 550° C. or higher and 1000° C. or lower. More specifically, the gas supply unit 20 is constructed so as to eject the air A from each nozzle 21 of the gas supply unit 20 if temperatures of the material pipes P introduced into the reheating furnace 10 are 550° C. or higher and 1000° C. or lower in a state of being placed on the foregoing respective pockets 14 (six successive pockets 14 provided from the side closest to the inlet 11 toward the material pipe carrying out side) of the fixed beam 13. In addition, as a temperature of the material pipe P placed on the foregoing each pocket 14, an actually-measured temperature previously measured by use of a thermocouple or the like for various parameters such as a temperature of atmosphere in the reheating furnace 10, a temperature of the material pipe P at the time when the material pipe is introduced into the reheating furnace 10, and a dimension of the material pipe P may be used. Alternatively, based on the various parameters, a temperature of the material pipe P can be calculated by use of a heat transfer calculation model. Then, it may be determined whether or not the actually-measured temperature or calculated temperature is 550° C. or higher and 1000° C. or lower.

Figure 1:
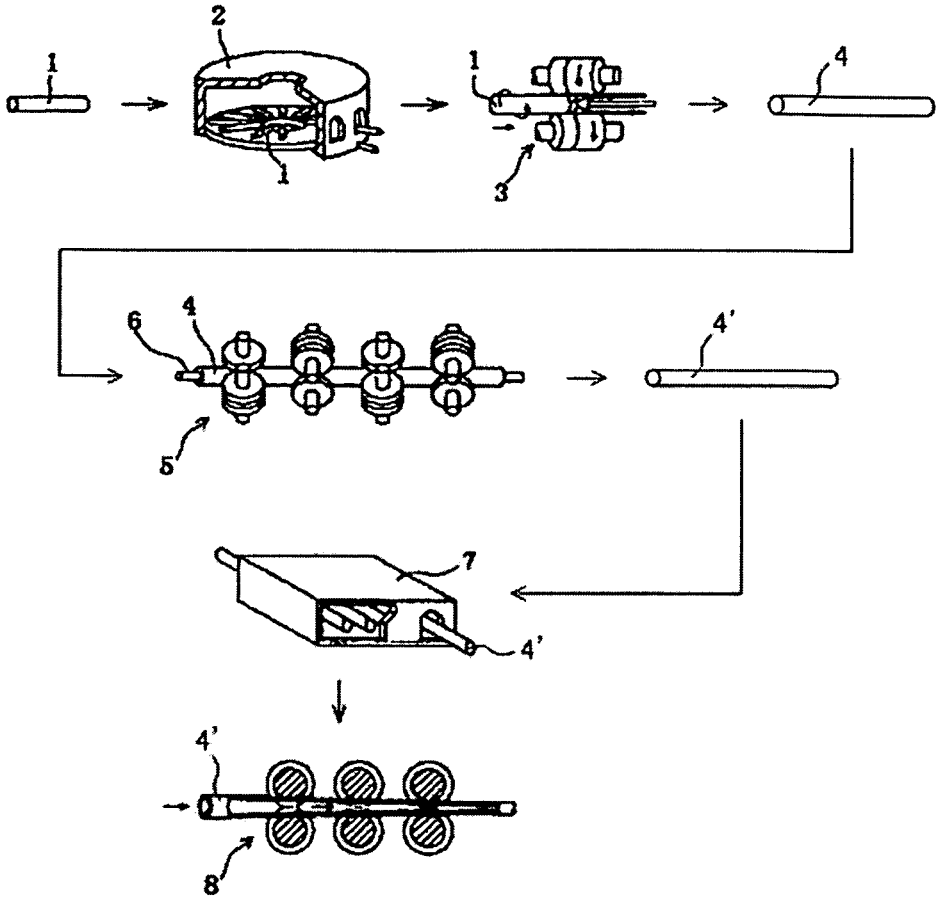
FIG. 1 is an illustrative view for explaining a production process of a seamless pipe by a mandrel mill method.
Figure 2:
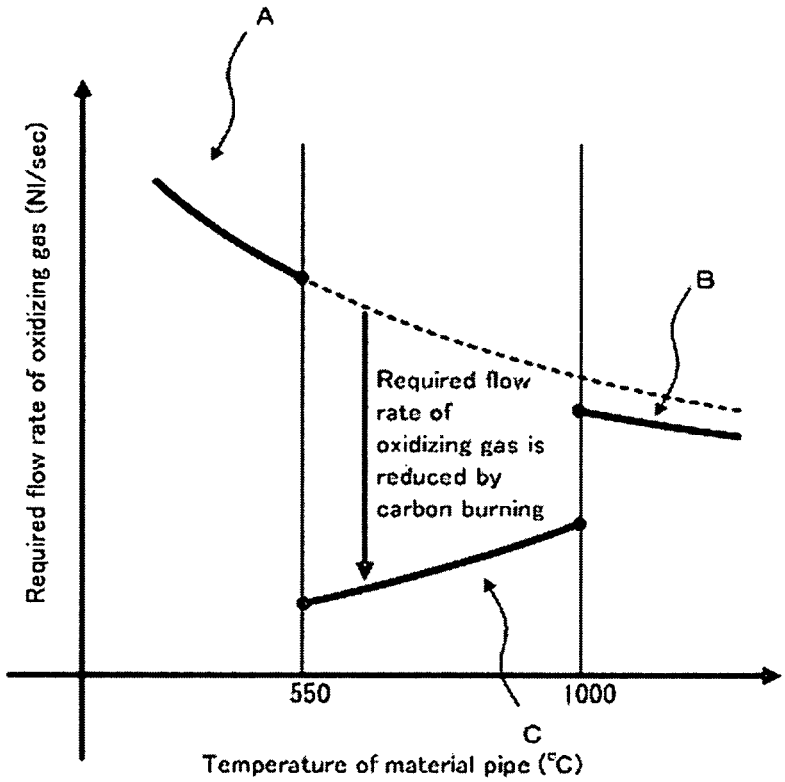
FIG. 2 is a graph schematically showing a relationship between a temperature of a material pipe and a flow rate of an oxidizing gas required for preventing the carburized layer from being produced (or for decarburization).

Thus, if the air is fed into the material pipe P when a temperature of the material pipe P introduced in the reheating furnace 10 is 550° C. or higher and 1000° C. or lower, as described above with reference to FIG. 2, the carbon adhering to the inner surface of the material pipe P can be burnt even though an amount of air is small, while the diffusion of the carbon from the inner surface of the material pipe to the inside of the material pipe can be inhibited. Therefore, carburizing likely produced on an inner surface of the material pipe P can be inhibited effectively. Further, since a required amount of the air fed is small, a production cost and a facilities cost of the seamless pipe can be inhibited and carburizing can be readily inhibited.

Hereinafter, a method of determining a flow rate of the oxidizing gas (air in the present embodiment) fed into the material pipe P will be described.

First, the present inventors performed the following test 1 to test 3 in order to determine a flow rate (minimum flow rate) of the oxidizing gas to be fed using a heating furnace for a test (hereinafter, referred to as a test furnace).

<Test 1>

(1) Material of material pipe: SUS 304

(2) Dimension of material pipe: outer diameter 151 mm, thickness 4.0 mm, length 1000 mm (material pipe prepared by cutting the material pipe subjected to drawing and rolling by a mandrel mill)

(3) Temperature of atmosphere in the test furnace: 1050° C.

(4) Temperature of the material pipe at the time when the material pipe was introduced into the test furnace (preheating temperature): 550 to 800° C.

(5) Adhesion density of carbon applied to the mandrel bar in drawing and rolling: 15 g/m$^2$ Under the above-mentioned conditions (1) to (5), the material pipe was introduced into the test furnace and the oxidizing gas (air) was fed into the material pipe for two minutes. Thereafter, the material pipe was carried out of the test furnace and a carbon quantity on the inner surface of the material pipe was measured to evaluate the presence or absence of carburizing. These tests were repeated by appropriately changing the temperature of the material pipe at the time when the material pipe was introduced into the test furnace and the flow rate of the oxidizing gas to be fed.

Figure 4:
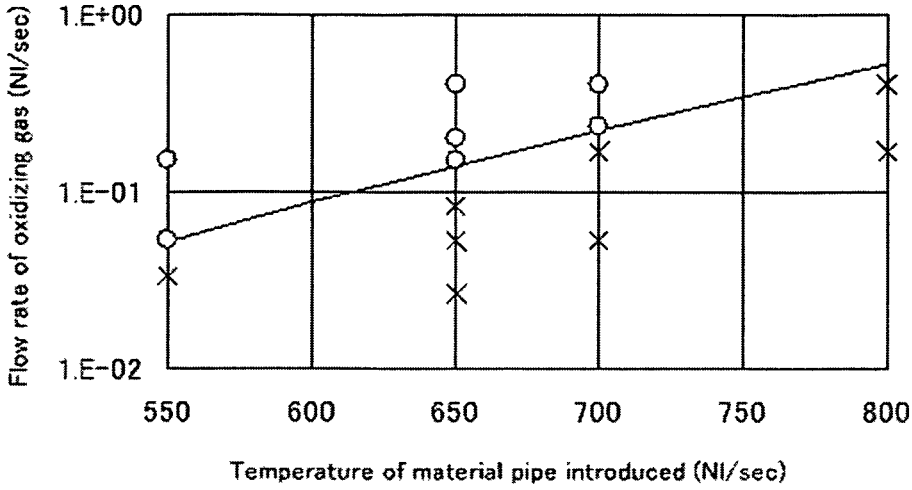
FIG. 4 is a graph showing an example of the results of the survey of a relationship between a temperature of the material pipe at the time when the material pipe is introduced into the reheating furnace and a flow rate of an oxidizing gas required for preventing the carburized layer from being produced.

FIG. 4 is a graph showing the results of the above test 1. Points denoted by a "○" in FIG. 4 represent data in which the carburizing did not occur (a ratio of carbon concentration increment on the inner surface of the material pipe to the set carbon concentration of the material pipe was 0.010% or less), and points denoted by a "x" represent data in which the carburizing occurred (a ratio of carbon concentration increment on the inner surface of the material pipe to the set carbon concentration of the material pipe was more than 0.010%). As shown in FIG. 4, it is found that when the temperature of the material pipe at the time when the material pipe is introduced into the test furnace is elevated (therefore, when the temperature of the material pipe at the time when the oxidizing gas is fed into the material pipe is elevated), the flow rate of the oxidizing gas required for preventing the carburized layer from being produced have to be increased.

<Test 2>

The same test as in test 1 was performed except for maintaining the temperature of the material pipe at the time when the material pipe was introduced into the test furnace at constant temperature of 650° C. and performing a test repeatedly for a plurality of material pipes having different dimensions.

Figure 5:
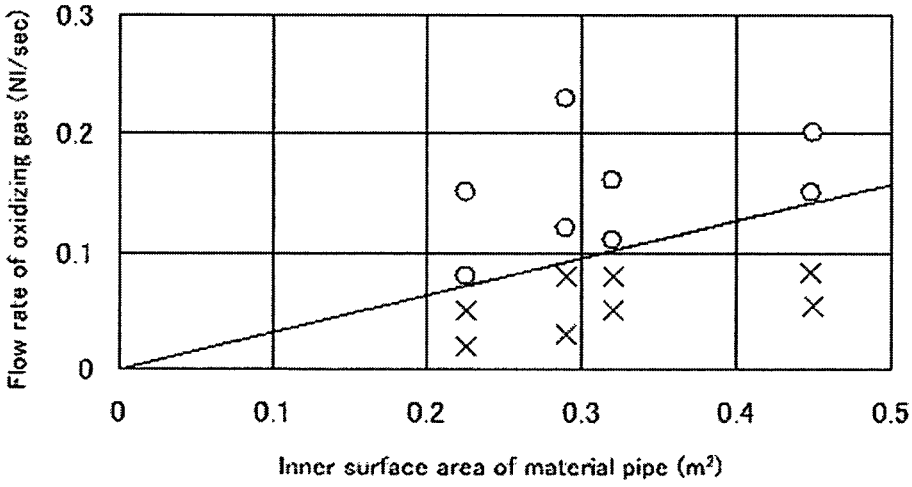
FIG. 5 is a graph showing an example of the results of the survey of a relationship between a dimension of the material pipe and a flow rate of the oxidizing gas required for preventing the carburized layer from being produced.

FIG. 5 is a graph showing the results of the above test 2. Points denoted by a "○" or a "x" in FIG. 5 represent the same as FIG. 4. As shown in FIG. 5, it is found that when the dimension of the material pipe (the inner surface area) is enlarged, the flow rate of the oxidizing gas required for preventing the carburized layer from being produced have to be increased (a required flow rate of the oxidizing gas is almost proportional to the inner surface area).

<Test 3>

The same test as in test 1 was performed except for maintaining the temperature of the material pipe at the time when the material pipe was introduced into the test furnace at constant temperature of 650° C. and performing a test repeatedly for a plurality of material pipes having different adhesion densities of carbon applied to the mandrel bar in drawing and rolling.

Figure 6:
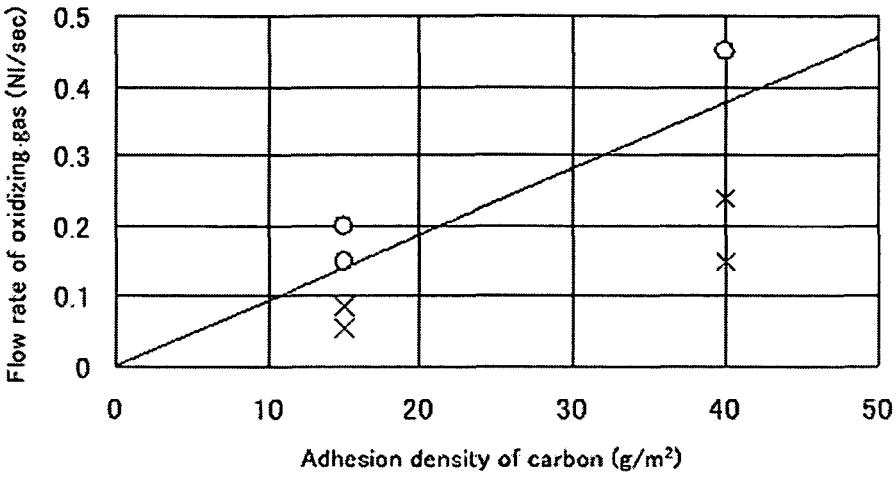
FIG. 6 is a graph showing an example of the results of the survey of a relationship between an adhesion density of carbon applied to a mandrel bar at the time of drawing and rolling and a flow rate of the oxidizing gas required for preventing the carburized layer from being produced.

FIG. 6 is a graph showing the results of the above test 3. Points denoted by a "○" or a "x" in FIG. 6 represent the same as FIG. 4. As shown in FIG. 6, it is found that when the adhesion densities of carbon applied to the mandrel bar in drawing and rolling is increased, the flow rate of the oxidizing gas required for preventing the carburized layer from being produced have to be increased (a required flow rate of the oxidizing gas is almost proportional to the adhesion densities of carbon).

The present inventors derived a calculation equation for determining a flow rate (minimum flow rate) of the oxidizing gas to be based on the test results of the above tests 1 to 3 using the test furnace and the various test results at the reheating furnace 10 installed on a production line of the seamless pipe. That is, in the production method of a seamless pipe or tube according to the present embodiment, a flow rate of the oxidizing gas fed into the material pipe or tube P is determined so as to satisfy the condition of the following equation (1):

$$Q \geq 7.7394 \times 10^{12} \cdot \exp\left(-\frac{22748}{(T_\infty + T_p) \times 0.5 + 273}\right) \cdot \frac{C_{in}}{T_{in} + 273} \cdot \frac{1}{\rho_c D_c} \cdot A_b \cdot \pi D_p L_p \quad (1)$$

wherein

Q represents a flow rate of the oxidizing gas [Nl/sec], $T_\infty$ represents a temperature of atmosphere in the reheating furnace [° C.], $T_p$ represents a temperature of the material pipe or tube at the time when the material pipe or tube is introduced into the reheating furnace [° C.], $C_{in}$ represents an oxygen content of the oxidizing gas [vol. %], $T_{in}$ represents a temperature of the oxidizing gas [° C.], $\rho_c$ represents a particle density of carbon which the lubricant applied to the mandrel bar contains [kg/m$^3$], $D_c$ represents a particle diameter of carbon which the lubricant applied to the mandrel bar contains [μm], $A_b$ represents an adhesion density of carbon which the lubricant applied to the mandrel bar contains [g/m$^2$], π represents Ludolphian number, Dp represents an inner diameter of the material pipe or tube [m] and $L_p$ represents a length of the material pipe or tube [m].

Table 1 shows an example of the feeding conditions of the oxidizing gas (air) at the reheating furnace 10 shown in FIG. 3 and the results of evaluating the presence or absence of the carburizing on the inner surface of the material pipe carried out from the reheating furnace at various conditions. In addition, numeric values shown in a box of "C adhering to bar" indicated in Table 1 represent an adhesion density $A_b$ of carbon which the lubricant applied to the mandrel bar contains, numeric values shown in a box of "Temperature of material pipe introduced" represent a temperature $T_p$ of the material pipe at the time when the material pipe is introduced into the reheating furnace, and numeric values shown in a box of "Flow rate of gas" represent a flow rate Q of the oxidizing gas (air) fed into the material pipe P. The meanings of "○" and "x" shown in a box of "Carburizing evaluation" are the same as in FIGS. 4 to 6.

TABLE 1

| Condition | Size | C adhering to bar [g/m$^2$] | Oxidizing gas | Temperature of material pipe introduced [° C.] | Condition of claim 1 | Flow rate of gas [N1/sec] | Right side of equation (1) [N1/sec] | Condition of claim 2 | Carburizing evaluation |
|---|---|---|---|---|---|---|---|---|---|
| No.1 | A | 15 | Air | 400 | x | 7.0 | 0.3 | ○ | x |
| No.2 | | | | 600 | ○ | 1.4 | 2.6 | x | x |
| No.3 | | | | 600 | ○ | 4.2 | 2.6 | ○ | ○ |
| No.4 | | | | 600 | ○ | 7.0 | 2.6 | ○ | ○ |
| No.5 | | | | 800 | ○ | 7.0 | 15.9 | x | x |
| No.6 | | | | 1000 | ○ | 7.0 | 72.9 | x | x |
| No.7 | | 40 | Air | 600 | ○ | 1.4 | 7.0 | x | x |

TABLE 1-continued

| Condition | Size | C adhering to bar [g/m$^2$] | Oxidizing gas | Temperature of material pipe introduced [° C.] | Condition of claim 1 | Flow rate of gas [N1/sec] | Right side of equation (1) [N1/sec] | Condition of claim 2 | Carburizing evaluation |
|---|---|---|---|---|---|---|---|---|---|
| No.8 | | | | 600 | ○ | 4.2 | 7.0 | x | x |
| No.9 | | | | 600 | ○ | 7.0 | 7.0 | ○ | ○ |
| No.10 | | | | 800 | ○ | 7.0 | 42.4 | x | x |
| No.11 | B | 15 | Air | 400 | x | 7.0 | 0.1 | ○ | x |
| No.12 | | | | 600 | ○ | 1.4 | 1.1 | ○ | ○ |
| No.13 | | | | 600 | ○ | 4.2 | 1.1 | ○ | ○ |
| No.14 | | | | 600 | ○ | 7.0 | 1.1 | ○ | ○ |
| No.15 | | | | 800 | ○ | 7.0 | 6.9 | ○ | ○ |
| No.16 | | | | 1000 | ○ | 7.0 | 31.6 | x | x |
| No.17 | | 40 | Air | 600 | ○ | 1.4 | 3.0 | x | x |
| No.18 | | | | 600 | ○ | 4.2 | 3.0 | ○ | ○ |
| No.19 | | | | 600 | ○ | 7.0 | 3.0 | ○ | ○ |
| No.20 | | | | 800 | ○ | 7.0 | 18.4 | x | x |

In addition, A in a box of "Size" in Table 1 represents; an inner diameter $D_p$ of the material pipe is 0.143 m and a length $L_p$ is 30 m. B in a box of "Size" in Table 1 represents; an inner diameter $D_p$ of the material pipe is 0.092 m, and a length $L_p$ is 20 m. Further, as for the conditions not described in Table, a temperature $T_\infty$ of atmosphere in the reheating furnace 10 is set at 1000° C., an oxygen content $C_{in}$ of the oxidizing gas is set at 20 vol. %, a temperature $T_{in}$ of the oxidizing gas is set at 25° C., a particle density $\rho_c$ of carbon which the lubricant applied to the mandrel bar contains is set at 1000 kg/m$^3$, and a particle diameter $D_c$ of carbon which the lubricant applied to the mandrel bar contains is set at 25 μm.

As shown in Table 1, when the oxidizing gas is fed at a flow rate satisfying the condition of the equation (1) (No. 3, 4, 9, 12 to 15, 18, and 19), the carburizing does not occur. Further, when the temperature of the material pipe P introduced into the reheating furnace 10 is too low (No. 1, 11), it is found that the material pipe P fails to satisfy the temperature condition of 550° C. or higher and 1000° C. or lower at the timing when the oxidizing gas is fed, and consequently the carburizing occurs even though the oxidizing gas is fed at a condition satisfying the equation (1).

The invention claimed is:

1. A production method of a seamless pipe or tube comprising the steps of:

heating a billet in a heating furnace, subjecting the heated billet to piercing and rolling by a piercer to produce the hollow shell, applying a lubricant containing carbon to a mandrel bar, subjecting the hollow shell to drawing and rolling in a mandrel mill using the mandrel bar to which the lubricant is applied, to produce a material pipe or tube, and reheating the material pipe or tube in a reheating furnace, wherein when a temperature of the material pipe or tube is 550° C. or higher and 1000° C. or lower in the reheating step, an oxidizing gas is fed into the material pipe or tube, a flow rate of the oxidizing gas being determined so as to satisfy the condition of the following equation (1):

$$Q \geq 7.7394 \times 10^{12} \cdot \exp\left(-\frac{22748}{(T_\infty + T_p) \times 0.5 + 273}\right) \cdot \frac{C_{in}}{T_{in} + 273} \cdot \frac{1}{\rho_c D_c} \cdot A_b \cdot \pi D_p L_p, \quad (1)$$

wherein

Q represents a flow rate of the oxidizing gas [Nl/sec], $T_\infty$ represents a temperature of atmosphere in the reheating furnace [° C.], $T_p$ represents a temperature of the material pipe or tube at the time when the material pipe or tube is introduced into the reheating furnace [° C.], $C_{in}$ represents an oxygen content of the oxidizing gas [vol. %], $T_{in}$ represents a temperature of the oxidizing gas [° C.], $\rho_c$ represents a particle density of carbon which the lubricant applied to the mandrel bar contains [kg/m$^3$], $D_c$ represents a particle diameter of carbon which the lubricant applied to the mandrel bar contains [μm], $A_b$ represents an adhesion density of carbon which the lubricant applied to the mandrel bar contains [g/m$^2$], π represents Ludolphian number, Dp represents an inner diameter of the material pipe or tube [m] and $L_p$ represents a length of the material pipe or tube [m].

2. An oxidizing gas supply unit used in a reheating step in the production method of a seamless pipe or tube comprising the steps of heating a billet in a heating furnace, subjecting the heated billet to piercing and rolling by a piercer to produce the hollow shell, applying a lubricant containing carbon to a mandrel bar, subjecting the hollow shell to drawing and rolling in a mandrel mill using the mandrel bar to which the lubricant is applied, to produce a material pipe or tube, and reheating the material pipe or tube in a reheating furnace, wherein the oxidizing gas supply unit is installed in a walking beam reheating furnace in which the material pipe or tube is placed on one of pockets provided on a moving beam and a fixed beam and successively shifted to the other pocket alternately between two kinds of beams to be carried, and the oxidizing gas supply unit includes nozzles which are respectively disposed at the sides of a plurality of successive pockets provided from the side, which is closest to the material pipe or tube introducing inlet of the fixed beam, toward the material pipe ore tube carrying out side of the fixed beam and each of which ejects an oxidizing gas toward the inside of the material pipe or tube placed on each pocket of the fixed beam when a temperature of the material pipe or tube is 550° C. or higher and 1000° C. or lower, a flow rate of the oxidizing gas being determined so as to satisfy the condition of the following equation (1):

$$Q \geq 7.7394 \times 10^{12} \cdot \exp\left(-\frac{22748}{(T_\infty + T_p) \times 0.5 + 273}\right) \cdot \frac{C_{in}}{T_{in} + 273} \cdot \frac{1}{\rho_c D_c} \cdot A_b \cdot \pi D_p L_p, \quad (1)$$

wherein

Q represents a flow rate of the oxidizing gas [Nl/sec], $T_\infty$ represents a temperature of atmosphere in the reheating furnace [° C.], $T_p$ represents a temperature of the material pipe or tube at the time when the material pipe or tube is introduced into the reheating furnace [° C.], $C_{in}$ represents an oxygen content of the oxidizing gas [vol. %], $T_{in}$ represents a temperature of the oxidizing gas [° C.], $\rho_c$ represents a particle density of carbon which the lubricant applied to the mandrel bar contains [kg/m$^3$], $D_c$ represents a particle diameter of carbon which the lubricant applied to the mandrel bar contains [μm], $A_b$ represents an adhesion density of carbon which the lubricant applied to the mandrel bar contains [g/m$^2$], π represents Ludolphian number, Dp represents an inner diameter of the material pipe or tube [m] and $L_p$ represents a length of the material pipe or tube [m].

* * * * *

UNITED STATES PATENT AND TRADEMARK OFFICE

CERTIFICATE OF CORRECTION

PATENT NO. : 8,464,568 B2
APPLICATION NO. : 12/225726
DATED : June 18, 2013
INVENTOR(S) : Nakaike et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1297 days.

Signed and Sealed this
Eighth Day of September, 2015

Michelle K. Lee

Michelle K. Lee
*Director of the United States Patent and Trademark Office*